United States Patent [19]

Dohmann

[11] 4,008,599

[45] Feb. 22, 1977

[54] APPARATUS FOR MAKING BEVEL GEAR

[75] Inventor: Fritz Dohmann, Ruckersdorf, Germany

[73] Assignee: Kabel-und Metallwerke Gutehoffnungshutte Aktiengesellschaft, Hannover, Germany

[22] Filed: Sept. 26, 1975

[21] Appl. No.: 617,008

[30] Foreign Application Priority Data

Sept. 28, 1974 Germany ..... 2446413

[52] U.S. Cl. ..... 72/354; 29/159.2; 72/358; 72/377

[51] Int. Cl.[2] ..... B21D 22/00; B21D 53/28

[58] Field of Search ..... 72/352, 353, 354, 358, 72/360, 357, 377; 29/159.2

[56] References Cited

UNITED STATES PATENTS

| | | | |
|---|---|---|---|
| 3,174,318 | 3/1965 | Fox | 72/358 X |
| 3,731,516 | 5/1973 | Dohmann et al. | 72/354 |
| 3,803,896 | 4/1974 | Cermal | 29/159.2 X |
| 3,832,763 | 9/1974 | Schober | 29/159.2 |

*Primary Examiner*—Leon Gilden
*Attorney, Agent, or Firm*—Ralf H. Siegemund

[57] ABSTRACT

A die with bevel gear-forming cavity, a punch and a sleeve-like counter punch are constructed for press-forming cylindrical blanks. The punch has a diameter about equal to the circle defined by the intersection of the pitch cone with the low diameter bottom of the die cavity. The counter punch has a frusto-conical projection reaching in the cavity and is held until the die cavity is filled underneath, whereafter the counter punch retracts at a declining speed to fill the remainder of the cavity by radial flow.

3 Claims, 1 Drawing Figure

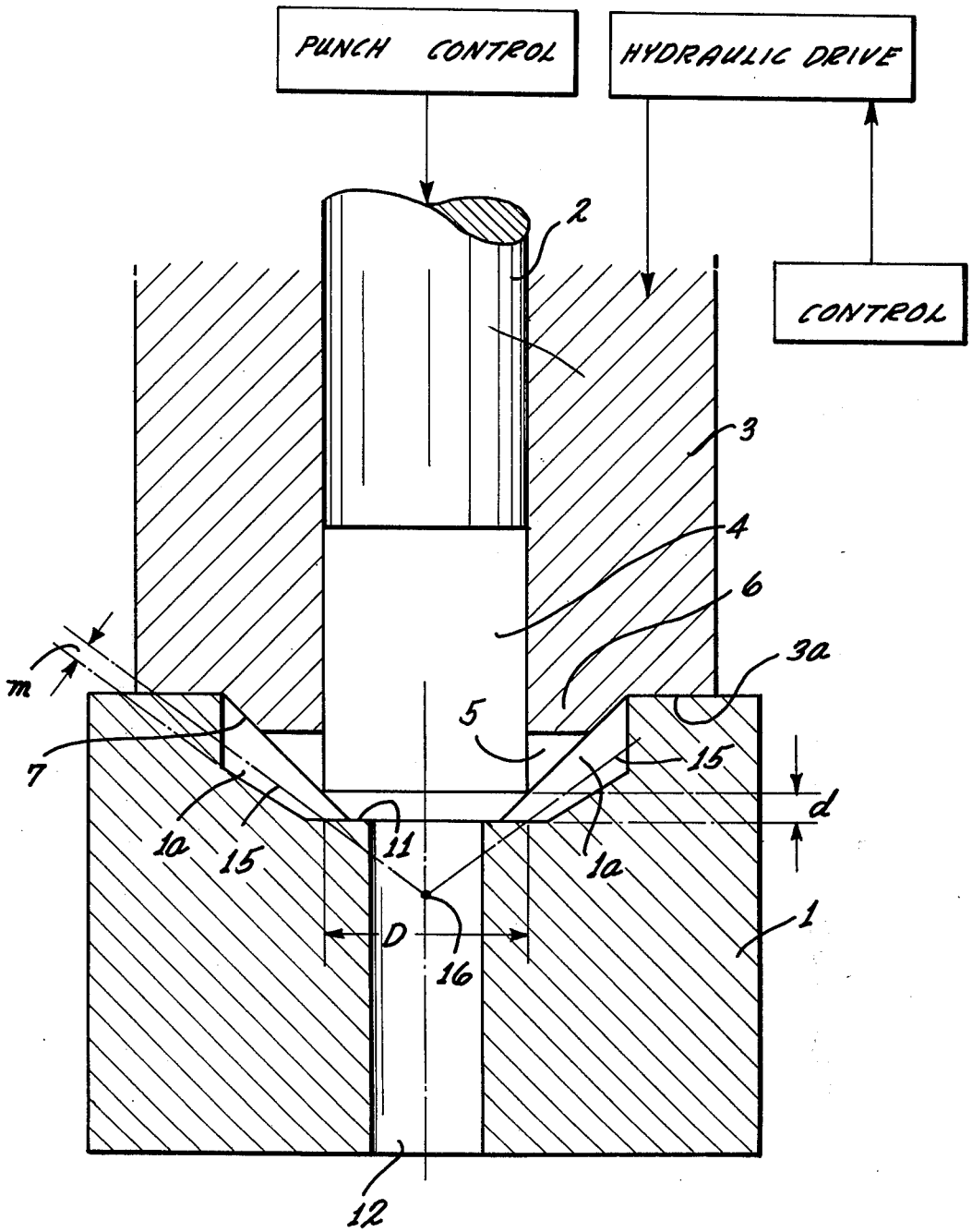
PUNCH CONTROL
HYDRAULIC DRIVE
CONTROL
2
3
4
6
3a
m
5
7
15
d
10
15
11
10
D
16
1
12

APPARATUS FOR MAKING BEVEL GEAR

BACKGROUND OF THE INVENTION

The present invention relates to the manufacture of bevel gear without machining (cutting), but using cylindrical, metallic blanks, e.g. steel blanks.

The equipment commonly used for making bevel gear has usually a lower die, which is contoured in accordance with the bevel gear to be made by forcing the blank into the die by means of a press ram or punch. The punch is, for example, guided in a coaxial sleeve or tube, in which the punch moves. Tooling of that kind is, for example, disclosed in the U.S. Pat. No. 3,731,516 by me and others. The invention relates specifically to improvements in equipment of the kind of equipment in the general sense as outlined above.

Bevel gears are, for example, made by hot forging, wherein a blank is forged by means of a punch and a die. This method does not require machining and the forging is carried out in a protective gas atmosphere. The German Pat. No. 1,048,766 discloses such a method, and the blank to be used here has a diameter which is smaller than the smallest inner diameter of the die as determining the contour of the teeth. Moreover, the blank is tapered at the end where facing the bottom of the die. It can be seen that the blank requires extensive preparations to be undertaken prior to working proper. The principal purpose of these preparations is to make sure that the teeth defining cavity portions of the die are really filled. These preparations as well as heating the blank in a protective gas are quite expensive.

My U.S. Pat. No. 3,675,459 discloses convexly contoured blanks, which though also requiring some preparations, are still less expensive to make. Such blanks can be made e.g. from sheared rods in automated cold working machines. This type of blank permits even working without heating and without a protective gas atmosphere. Still, the barrel or ball-shaped blanks do require some preparations.

DESCRIPTION OF THE INVENTION

It is an object of the present invention to provide for a method of making bevel gear without machining, but by means of press-working merely cylindrical blanks without further preparation, and in a manner in which filling of a die cavity is assured with certainty.

It is a specific object of the invention to improve equipment of the type outlined above, so that cylindrical blanks can be used.

In order to achieve the desired purpose, it must be realized that uniform and complete filling of the various portions of the die cavity can be obtained only, if the (cold) flow of the blank material can be controlled so that all tooth-defining cavities in the die are completely filled prior to the point where the flowing material runs against an internal die boundary corresponding to the largest diameter of the gear. The upper tooling must be provided accordingly.

The apparatus improved by the invention has a die with bevel gear contour of its cavity, a punch and a sleeve-like, coaxial counter-punch receiving the punch. In accordance with the preferred embodiment of the present invention, it is suggested to provide the counter-punch with a conical front end that projects into the die cavity and recedes when the cavity portion underneath is filled. The inner diameter of the counter-punch corresponding to the outer diameter of the punch itself is to be about equal to the circle defined by the intersection of the pitch cone of the gear and of the bottom plane of the die cavity (corresponding to the small diameter end of the bevel gear to be made), at an accuracy of less then 20 % deviation from that rule.

It was found that equipment of this type permits press-forming of merely cylindrically contoured blanks. The latter when placed into the mold sits on the ridges of the cavity at a distance from the bottom which is about equal to the two to three fold value of the addendum of the bevel gear.

During press-forming, the counter punch is at first retained on the die so that its frusto-conical projection sits on the ridges of the die (the ridges define the grooves of the bevel gear) and projects into the die cavity until the portion of that cavity underneath is filled, whereafter the counter punch is retracted at a declining rate so that the cavity and here particularly the tooth defining portions thereof are filled by essentially radial flow of the material.

DESCRIPTION OF THE DRAWING

While the specification concludes with claims particularly pointing out and distinctly claiming the subject matter which is regarded as the invention, it is believed that the invention, the objects and features of the invention and further objects, features, and advantages thereof will be better understood from the following description taken in connection with the accompanying drawings in which:

the FIGURE illustrates a cross-section through bevel gear forming tooling in accordance with the preferred embodiment of the invention.

Proceeding now to the detailed description of the drawing, the FIGURE shows a die 1 with a bevel-conical die cavity 5, whose side has alternatingly ridges 1*a* and recesses, whereby the recesses are the cavities for obtaining the teeth of the gear, and the ridges 1*a* will establish the grooves between the teeth. The die has a bottom 11 in which terminates a bore 12 for the ejector. That part is conventional.

As far as the geometry of the die cavity is concerned, reference numeral 15 refers to the pitch cone of the gear to be made. That cone has an apex 16. The smallest diameter of any circle defined by that pitch cone and still on the gear teeth has the diameter D. In this instance that circle is situated in bottom plane 11 of the die. The character *m* refers to a gear modulus also known as addendum of the gear to be made.

The press-forming tooling includes a ram or punch 2, which slides in a sleeve-like counter punch 3. Punch and counter punch are situated on the same side of the die cavity and are disposed in coaxial relation to each other. The counter punch 3 has a front or bottom end which is contoured to have in parts frusto-conical configuration 6. The wide portion of that truncated cone 6 projects from an annular flat front end 3*a* of the counter-punch. The axial height of that truncated cone, i.e. its elevation (down) from the plane of front 3*a* is to be about twice the value of *m* introduced above. The outer, conical surface of the projection 6 is denoted with reference numeral 7, and the apex angle of the respective cone corresponds to the conical surface that is being defined by the apices of all ridges 1*a* of the die 1, which in turn establishes the root cone of the bevel gear.

The ram or punch 2 has a diameter (corresponding to the inner diameter of counter punch 3), which is determined by the requirement of a specific relation to the die. That diameter is to coincide (with an accuracy of not more than ± 20 % deviation) with the diameter D of the circle which was defined earlier by the intersection of the pitch cone 15 with the bottom plane 11 of the die.

In view of the tooling as defined, the blank 4 can be and is of cylindrical configuration, whereby the diameter of that blank is the same diameter D introduced above. The axial length of that blank 4 depends on the axial dimension as well as on the apex of the bevel (and pitch cone) as defining the volume needed for obtaining the desired bevel gear.

The bevel gear forming process is carried out as follows: At first, a blank, such as 4 is just placed symmetrically into the die cavity 5 to assume a disposition on the ridges 1*a* as illustrated. This disposition is characterized by a distance *d* of the lower front of blank 4 from die cavity bottom 11, which is about two to three-fold the value of bevel gear modulus-addendum *m* as defined above.

Now the upper tooling, punch 2 and counter punch 3 is lowered, whereby particularly the annular front 3*a* of counter-punch 3 is seated on the top of the die, and the truncated cone 6 penetrates into the die cavity while being seated on the upper part of the ridges 1*a*. Next, punch 2 is lowered and the cold working begins. It can readily be seen that the blank 4 is pushed down as a whole, while material as displaced in the blank by the bottom-near portions of the ridges 1*a* will flow radially into the cavities between these ridges. In reality, cold flow is practically exclusively a radial one during these first phases of the process.

As the front of the blank reaches the bottom, higher portions of the blank begin to participate more and more in the flow and flow around the cone 6, still predominantly radially, into the teeth defining cavities. This flow continues until these cavities are filled particularly below the front end of the truncated cone 6. Some material will then flow up along the cone surface 7, but the counter-punch 3 will be lifted. The counter punch 3 should not be subject to free lifting, but a holding force should hold the counter-punch down and permit only its controlled lifting, so that flow of material to the outermost gear-defining cavity portions is ensured and the filling of the entire cavity continues in the same level everywhere and by radial flow. The force acting on counter punch 3 should, in fact, gradually be reduced to permit controlled lifting without free displacement. The drive control for counter-punch 3 will be carried out as follows:

As stated above, the lower portion of the die is filled completely while the couter-punch 3 remains in the seated position. When this lower portion of the die cavity is filled, continued punch movement will cause the material to exert a considerable force upon the counter-punch 3 tending to lift it. If necessary, this increase in force can be monitored to begin retraction of the counter-punch 3 in a controlled rate. However, that completion can also be determined by a particular disposition of punch 2, except that length tolerances in the blanks render this indicator less reliable than an increase in force against counter-punch 3.

If it is assumed that the punch 2 is lowered at a particular rate, the amount of material forced into the die cavity per unit time is commensurate with that rate. That material, as stated, flows predominantly radially. As counter-punch 3 is lifted by a particular increment, a particular incremental volume is made newly available to receive material. For similar increments of sleeve retraction, that incremental volume is the larger the higher the sleeve already is, because the die cavity widens on account of the conical contour. Thus, for a constant radial flow rate of material on account of a constant speed of the punch 2, the speed of retraction of the counter punch 3 should decrease linearly.

Counter punch 3 can be driven hydraulically and controlled in that at first it remains seated and is hydraulically held onto the die, until the lower portion of the die cavity is filled. That filling will occur at a particular advance of punch 2 and either that position of the punch or the increase in force acting on the counter punch 3 or both can be used to control the beginning of retraction of the counter punch 3. That speed is rather high at first so that the initial acceleration of counter punch 3 is high, but reverses rapidly as the speed of counter punch 3 is controlled to decline to zero at the end of the press working. The control can be carried out in feedback configuration in that the hydraulic drive for counter punch 3 retracts, while a constant pressure is being maintained in the drive. This retraction will automatically stop when the punch 2 stops. The punch 2 may stop, for example, in a particular position relative to the die or when its front end is aligned with the end face of truncated cone 6. In either case retraction of counter punch 3 and advance of punch 2 are stopped simultaneously.

It can readily be seen that for a constant speed of punch 2 the speed of counter punch will decline linearly. For non-constant punch speed the decline of the speed of sleeve 3 is more complex. If punch 2 is controlled to advance at a linear rate (constant speed), speed control for counter punch 3 is possible at a linearly declining speed by controlling the hydraulic drive for the counter-punch accordingly, using, possibly, pressure supervision only as an override.

In a simplified version of control of the retraction of counter punch 3, the counter punch is held down during filling of the lower portion of the die by a latch or any other stop which is released upon completion of filling the lower die cavity. The continued filling forces the counter punch 3 up, but the counter punch is biased by means of plate or cup springs, which retard the up movement, and the springs as compressed react against further compression by a linearly increasing force acting against the counter punch 3, so that the up movement of the latter does, in fact, decline as to speed until e.g. upon complete compression of the springs the up movement is stopped. The position of the counter punch is changed in a quasi-stationary manner in that the counter punch 3 runs through a sequence of stationary dispositions as far as material and spring force interaction is concerned. Of course, stopping of the punch will also cause stopping of counter punch retraction.

Still alternatively, the springs can be replaced by a hydrostatic cushion whose pressure is caused to increase linearly with displacement of counter punch 3 to retard the upward displacement of the latter so that again the counter punch retracts rather fast at first, but stops upon completion of the extrusion of the blank by the punch. This operation is somewhat analogous to the hydraulic drive mentioned above. The controlled cushioning runs the hydraulic pressure (e.g. by bleeding off hydraulic fluid) at a controlled rate so that the counter punch follows its path at a declining speed as required.

The invention is not limited to the embodiments described above, but all changes and modifications thereof not constituting departures from the spirit and scope of the invention are intended to be included.

I claim:

1. In an apparatus for making bevel gear the apparatus having a die with a cavity corresponding to the contour of the bevel gear to be made, the cavity having a bottom at the smallest gear diameter and ridges corresponding to the grooves of the bevel gear, the ridges also defining the pitch cone for the bevel gear, the apparatus further having a punch and a counter-punch, the punch moving axially in the counter punch both being situated at the same side of the die, the improvement comprising:

the punch having an outer diameter and the counter punch having a corresponding inner diameter, these diameters being equal to the diameter of a circle defined by the intersection of said pitch cone with said bottom, at an accuracy of not more than 20 % tolerance; and the counter punch having a lower front face from which projects a truncated, conical projection having a contour corresponding to a cone as defined by said ridges, said counter-punch being disposed for retraction in a direction opposite to the punch as moving during pressing a blank into the die cavity.

2. In an apparatus as in claim 1, wherein the frusto-conical projection has a height about equal to twice a value for the addendum of the bevel gear.

3. In an apparatus as in claim 1, and including means for retracting the counter punch at a controlled rate and declining speed or retraction following the filling of the die cavity underneath the truncated cone.

* * * * *